US010174603B2

(12) United States Patent
Barfoed et al.

(10) Patent No.: US 10,174,603 B2
(45) Date of Patent: Jan. 8, 2019

(54) DOWNHOLE VISUALISATION METHOD

(71) Applicant: WELLTEC A/S, Allerød (DK)

(72) Inventors: Jens Barfoed, Copenhagen (DK); Jørgen Hallundbæk, Græsted (DK)

(73) Assignee: WELLTEC A/S, Allerod (DK)

( * ) Notice: Subject to any disclaimer, the term of this patent is extended or adjusted under 35 U.S.C. 154(b) by 286 days.

(21) Appl. No.: 14/365,882

(22) PCT Filed: Dec. 28, 2012

(86) PCT No.: PCT/EP2012/077006
§ 371 (c)(1),
(2) Date: Jun. 16, 2014

(87) PCT Pub. No.: WO2013/098363
PCT Pub. Date: Jul. 4, 2013

(65) Prior Publication Data

US 2014/0340506 A1 Nov. 20, 2014

(30) Foreign Application Priority Data

Dec. 29, 2011 (EP) ..... 11196115

(51) Int. Cl.
*G06F 19/00* (2018.01)
*E21B 44/00* (2006.01)
(Continued)

(52) U.S. Cl.
CPC ..... *E21B 47/0002* (2013.01); *E21B 47/124* (2013.01); *E21B 47/12* (2013.01)

(58) Field of Classification Search
CPC ..... E21B 47/0002; E21B 47/124
See application file for complete search history.

(56) References Cited

U.S. PATENT DOCUMENTS 2,849,530 A * 8/1958 Fleet ..... E21B 47/0002 307/91
5,602,541 A * 2/1997 Comeau ..... E21B 7/04 175/45

(Continued)

FOREIGN PATENT DOCUMENTS

CN 1932239 3/2007
EA 009357 12/2007

(Continued)

OTHER PUBLICATIONS

Notification of First Office Action for Chinese Application No. 201280061764.0, dated Jul. 1, 2016 (with English Translation) (15 pages).

(Continued)

*Primary Examiner* — Sathyanaraya V Perungavoor
*Assistant Examiner* — Philip P. Dang
(74) *Attorney, Agent, or Firm* — Nixon & Vanderhye P.C.

(57) ABSTRACT

The present invention relates to a method of visualizing a downhole environment using a downhole visualization system. The downhole visualization system comprises a downhole tool string comprising one or more sensors, a downhole data processing means for processing the sensor signals to provide sensor data, an uphole data processing means for uphole processing and visualization, and a data communication link operable to convey the sensor data from the downhole data processing means to the uphole data processing means, the sensors being capable of generating sensor signals indicative of one or more physical parameters in the downhole environment. The downhole visualization system further comprises a downhole data buffering means capable of receiving the sensor data from the downhole data processing means and temporarily storing the sensor data in the downhole data buffering means.

17 Claims, 5 Drawing Sheets

(51) Int. Cl.

| | |
|---|---|
| ***H04N 9/47*** | (2006.01) |
| ***E21B 47/00*** | (2012.01) |
| ***E21B 47/12*** | (2012.01) |

(56) References Cited

U.S. PATENT DOCUMENTS

| | | | | |
|---|---|---|---|---|
| 5,652,617 | A * | 7/1997 | Barbour | E21B 47/0002 348/85 |
| 5,697,445 | A * | 12/1997 | Graham | E21B 7/061 166/117.6 |
| 5,715,891 | A * | 2/1998 | Graham | E21B 7/061 166/117.6 |
| 5,899,958 | A * | 5/1999 | Dowell | E21B 47/0002 175/50 |
| 5,992,524 | A * | 11/1999 | Graham | E21B 7/061 166/117.6 |
| 6,006,844 | A * | 12/1999 | Van Puymbroeck | E21B 10/02 175/246 |
| 6,041,860 | A | 3/2000 | Nazzal et al. | |
| 6,061,551 | A * | 5/2000 | Sorrells | H03C 1/62 455/118 |
| 6,229,453 | B1 * | 5/2001 | Gardner | E21B 47/12 340/853.8 |
| 6,580,449 | B1 * | 6/2003 | Meltzer | E21B 47/0002 348/85 |
| 7,163,065 | B2 * | 1/2007 | Zhang | E21B 47/122 166/385 |
| 7,207,215 | B2 * | 4/2007 | Spross | E21B 7/067 73/152.03 |
| 7,705,878 | B2 * | 4/2010 | Mandal | H04N 7/183 348/85 |
| 7,743,654 | B2 * | 6/2010 | Spross | E21B 7/067 73/152.03 |
| 7,880,640 | B2 * | 2/2011 | Lovell | E21B 17/003 175/40 |
| 2003/0188862 | A1 * | 10/2003 | Streich | E21B 47/0002 166/250.01 |
| 2004/0024795 | A1 * | 2/2004 | Hind | G06F 17/30581 |
| 2005/0132794 | A1 * | 6/2005 | Spross | E21B 7/067 73/152.03 |
| 2010/0243241 | A1 * | 9/2010 | Hampton | G01V 8/02 166/250.01 |
| 2011/0087434 | A1 * | 4/2011 | Lie | E21B 47/0002 702/8 |

FOREIGN PATENT DOCUMENTS

| | | |
|---|---|---|
| EP | 2 317 068 | 5/2011 |
| EP | 2317068 | 5/2011 |
| WO | 2005/057240 | 6/2005 |

OTHER PUBLICATIONS

International Preliminary Report on Patentability dated Jul. 10, 2014 in International Application No. PCT/EP2012/077006 (7 pages).

International Search Report for PCT/EP2012/077006 dated Feb. 13, 2013.

Written Opinion of the International Searching Authority for PCT/EP2012/077006 dated Feb. 13, 2013.

Russian Decision to Grant for Application No. 2014128074/03(045476) and its English translation, dated Sep. 9, 2016 (18 pages).

* cited by examiner 2
3
10
12
13
200

DOWNHOLE VISUALISATION METHOD

This application is the U.S. national phase of International Application No. PCT/EP2012/077006 filed 28 Dec. 2012 which designated the U.S. and claims priority to EP 11196115.7 filed 29 Dec. 2011, the entire contents of each of which are hereby incorporated by reference.

FIELD OF THE INVENTION

The present invention relates to a method of visualising a downhole environment using a downhole visualisation system.

BACKGROUND ART

Uphole visual representation of a downhole environment is becoming increasingly relevant in order to optimise the production from a well. Logging tools capable of gathering information about the well have become more advanced in recent years, and due to the increased computational power and the increased data transfer rates of today from logging tools to uphole processors, visual real-time presentation of the downhole environment has been brought more into focus. Furthermore, dynamic logging with a downhole processor allows for different resolutions of the logging data to be controlled by a user located uphole.

However, dynamic logging requires user instructions to be sent from the uphole processor to the downhole processor, which burdens and limits the data transfer when high resolution logging data is transferred from the downhole to the uphole processor. Additionally, during operations, downhole data bandwidth is required for controlling tools in operation. Hence, data transfer is typically a trade-off between tool control and transfer of logging data.

SUMMARY OF THE INVENTION

It is an object of the present invention to wholly or partly overcome the above disadvantages and drawbacks of the prior art. More specifically, it is an object to provide an improved downhole visualisation method for visualisation of a downhole environment using sensor data indicative of downhole physical parameters in real-time.

The above objects, together with numerous other objects, advantages, and features, which will become evident from the below description, are accomplished by a solution in accordance with the present invention by a method of visualising a downhole environment using a downhole visualisation system comprising a downhole tool string comprising one or more sensors, a downhole data processing means for processing the sensor signals to provide sensor data, an uphole data processing means for uphole processing and visualisation, and a data communication link operable to convey the sensor data from the downhole data processing means to the uphole data processing means, the sensors being capable of generating sensor signals indicative of one or more physical parameters in the downhole environment, the downhole visualisation system further comprising a downhole data buffering means capable of receiving the sensor data from the downhole data processing means and temporarily storing the sensor data in the downhole data buffering means, said method comprising the steps of:

moving the downhole tool string within a downhole environment, sensing, during movement, one or more physical parameters using the one or more sensors generating sensor signals indicative of one or more physical parameters in the downhole environment, processing the sensor signals to provide sensor data, temporarily storing buffered sensor data in the downhole data buffering means obtained at a pre-set sample rate, transmitting a first part of the sensor data to the uphole data processing means at a pre-set first transmission rate equal to or lower than the sample rate, processing the first part of the sensor data using the uphole data processing means and visualising the downhole environment based on the first part of the sensor data, sending a control signal from the uphole data processing means to the downhole data processing means based on an event such as a sudden change in one or more of the physical parameters during the visualisation of the downhole environment, thereby changing the transmission rate from the first transmission rate to a second transmission rate, transmitting at least partially a second part of the sensor data stored in the downhole data buffering means to the uphole data processing means, and visualising the downhole environment based on the first part of the sensor data and the second part of the sensor data, chronologically before and after the event without reversing the movement of the downhole tool string.

In an embodiment, the second transmission rate may be higher than the first transmission rate and lower than the sampling rate.

The method as described above of visualising a downhole environment may further comprise a step of deleting the part of the buffered sensor data in the downhole data buffering means which has been transmitted to the uphole data processing means.

Also, the method as described above of visualising a downhole environment may further comprise a step of sending an additional control signal to change the speed of the downhole tool string from a first to a second speed.

Moreover, the method as described above of visualising a downhole may further comprise a step of changing the sampling rate from a first to a second sampling rate.

Furthermore, the method as described above of visualising a downhole environment may further comprise a step of transmitting a second part of sensor data at a second transmission rate and transmitting a third part of sensor data at a third transmission rate.

Finally, the method as described above of visualising a downhole environment may further comprise a step of visualising the downhole environment based on the transmitted first, second and third parts of the sensor data.

In an embodiment, the event may be a change in a casing structure, a formation structure or properties of fluids being present in the downhole environment.

In an embodiment, the transmission rate may be higher than the sampling rate when the sensor of the tool string moves past uninteresting parts of the well.

Also, the second transmission rate may be higher than the sampling rate.

Furthermore, the present invention also relates to a downhole visualisation system for real-time visualisation of a downhole environment, the downhole visualisation system comprising:

a downhole tool string comprising one or more sensors, the sensors being capable of generating sensor signals indicative of one or more physical parameters in the downhole environment, downhole data processing means for processing the sensor signals to provide sensor data, uphole data processing means for uphole processing and visualisation, and a data communication link operable to convey the sensor data from the downhole data processing means to the uphole data processing means, wherein the downhole visualisation system further comprises downhole data buffering means capable of receiving the sensor data from the downhole data processing means and temporarily storing the sensor data in the downhole data buffering means.

In one embodiment, the downhole visualisation system as described above may further comprise a downhole data storing means.

Moreover, a wireline may at least partially constitute the data communication link.

Also, the one or more sensors may be selected from the group consisting of laser sensors, capacitance sensors, ultrasound sensors, position sensors, flow sensors and other sensors for measuring physical parameters in a downhole environment.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
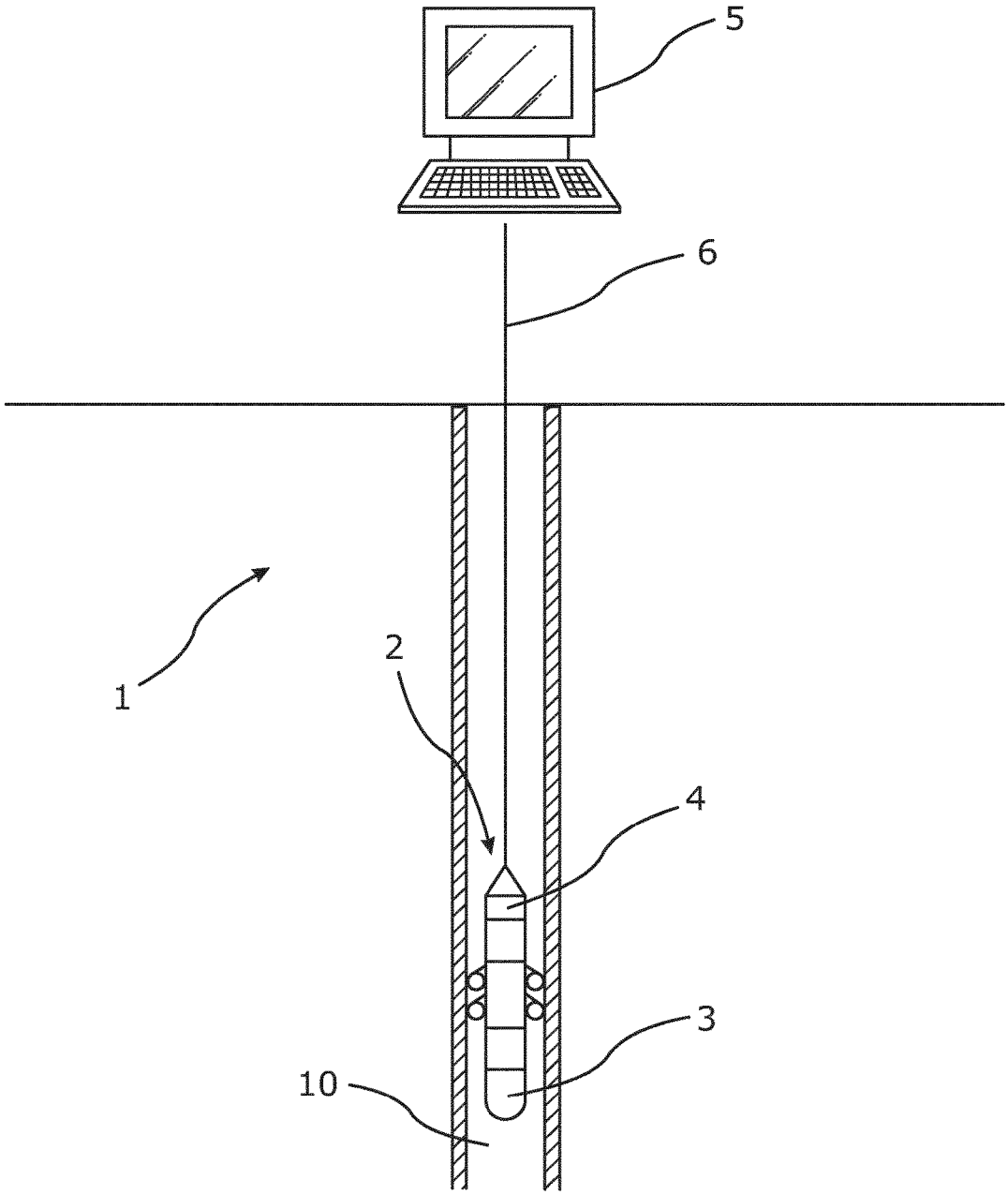
FIG. 1 shows an overview of a downhole visualisation system.

FIG. 1 shows a downhole visualisation system 1 for real-time visualisation of a downhole environment 10. The downhole visualisation system 1 comprises a downhole tool string 2, which may be lowered into the downhole environment 10. As shown, the downhole tool string 2 comprises a sensor 3 capable of sensing a physical parameter in the downhole environment 10 and generating sensor signals indicative of this physical parameter. A downhole tool string 2 may typically comprise several different sensors, e.g. magnetic sensors, laser sensors, capacitance sensors etc. The downhole visualisation system 1 furthermore comprises a downhole data processing means 4 for processing sensor signals 100 and sending information about the physical parameters via a data communication link 6 to an uphole data processing means 5 for the further uphole processing and real-time visualisation in order to provide a user with a visual representation of the downhole environment 10.

Figure 2:
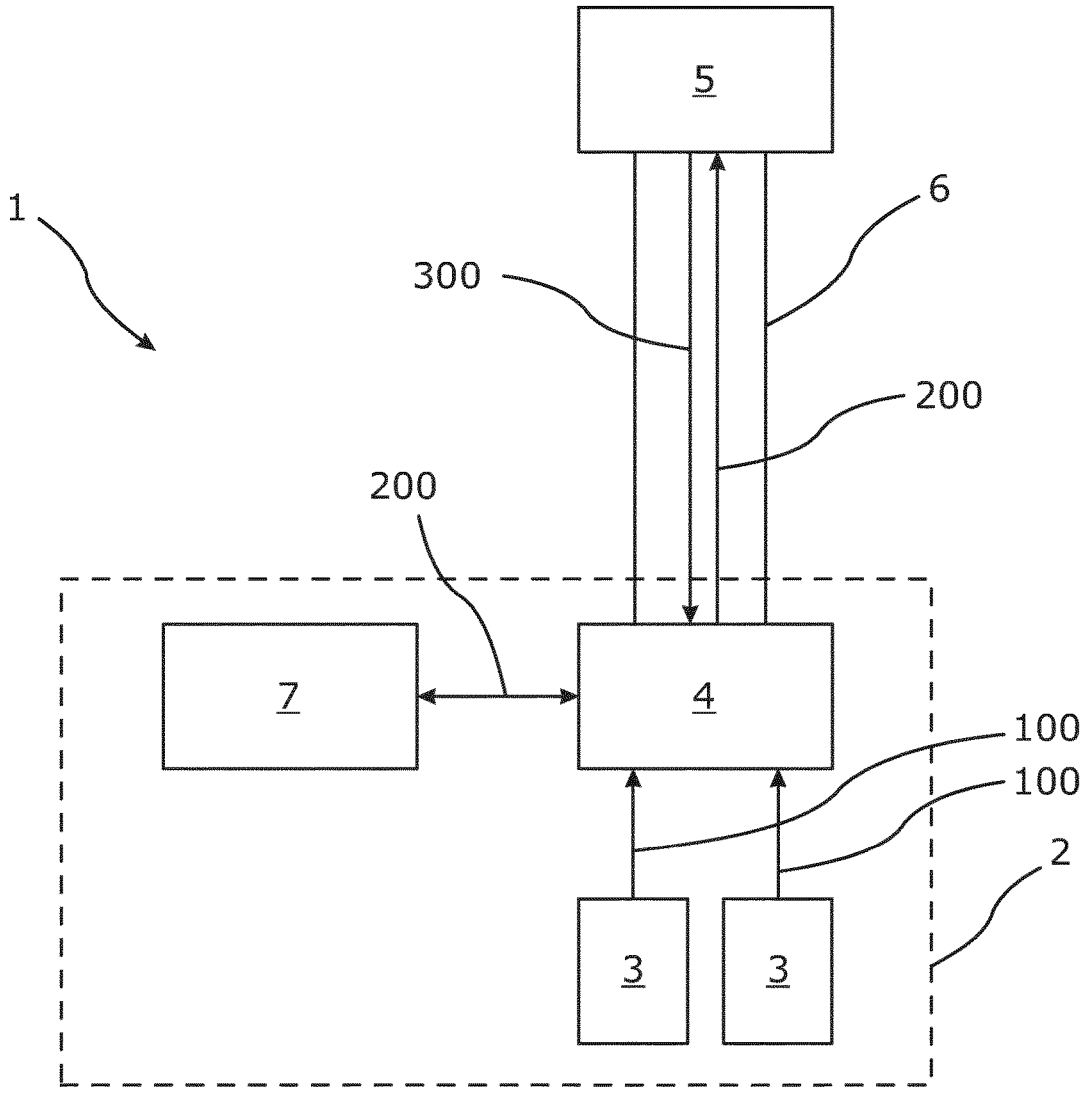
FIG. 2 shows a schematic diagram of a downhole visualisation system.

As shown in the schematic diagram of the visualisation system in FIG. 2, the one or more sensors 3 generate(s) sensor signals 100 indicative of physical parameters in the downhole environment. The sensor signals 100 are received by the downhole data processing means 4 which may convert the sensor signals 100 into a set of sensor data 200. All the sensor data 200 are temporarily stored in a downhole data buffering means 7 whereas only a first part of the sensor data 200 is transmitted from the downhole data processing means 4 to the uphole data processing means 5 for visualising the downhole environment. In order to minimise the amount of data transferred via the communication link 6, the amount of transmitted sensor data 200 is advantageously kept at a minimum without compromising the ability to do a meaningful visual representation of the downhole environment. When the downhole tool string 2 is moved e.g. through upper parts of a well, the only relevant information for the user may be the location of distance indicators such as casing collars to follow speed and position of the downhole tool string 2 in the well. For this purpose, a very low rate of transmitted data may be required to do a meaningful visual representation of the downhole environment, e.g. only every tenth member of a sampled sensor data 200 is transmitted to the surface.

By a low rate of transmitted data is meant a set of data corresponding to a long sampling period and a low sampling frequency, such as transmission of only every tenth member of the full sampled sensor data set 200, whereas a high rate of transmitted sensor data 200 means a set of data corresponding to a short sampling period and high sampling frequency, such as transmission of every second or all members of the full sampled sensor data set 200 of measured sensor data. However, if the user suddenly recognises an interesting feature in the visualisation based on the transmitted sensor data 200, the transmitted sensor data 200 does not necessarily contain sufficient information to be able to resolve the interesting feature, e.g. perhaps every second member of the sampled sensor data 200 is required to resolve the interesting feature. Normally, this would require the operator of the downhole tool string 2 to stop and move the downhole tool string 2 back beyond the point where the interesting feature was disclosed and then measure the volume of interest again using a higher sample rate. Measuring the volume of interest again may even lead to yet another repetition of the measurement if the resolution of the visualisation is still not high enough to resolve the interesting feature. Therefore, this approach is slow, tedious and also cost-ineffective. By having the downhole data buffering means 7, all sensor data 200 may instead at all times be stored temporarily downhole at the highest possible sampling rate. If or when the user suddenly recognises an interesting feature, the user may increase the rate of transmitted data to achieve a sufficiently high resolution forward in time and furthermore to extract data stored in the downhole data buffering means 7 in order to achieve a sufficiently high resolution backwards in time from the point in time of the visualisation when there is no interesting features to the point in time of the visualisation when there is an interesting feature. This change in resolution of the visualisation may be carried out while still moving forward in the well, and therefore neither precious time nor money is wasted.

The recognition of an interesting feature in the uphole real-time visualisation is not necessarily performed by a user, but may also be triggered directly by the downhole or uphole data processing means 4, 5, e.g. if the sensor data 200 from a sensor 3 exceeds a pre-set numerical value or a pre-set derivative value of the data such that the downhole or uphole data processing means 4, 5 automatically adjusts the rate of the sensor data 200 which is transmitted to the uphole data processing means 5.

Furthermore, the downhole data buffering means 7 may be used to improve redundancy of the sensor data 200. When the sensor data 200 is processed in the uphole data processing means 5, the sensor data 200 may be evaluated so that if members of the transmitted data seem to have a surprising value or a surprising derivative value, a control signal 300 may be sent to the downhole data processing means 4, requesting that the member of the transmitted sensor data 200 having a surprising value be extracted from the downhole data buffering means 7 and transmitted again to the uphole data processing means 5. If the same surprising value arrives at the uphole data processing means 5 again, it may be ruled out that the surprising value originates from a data transfer error in the communication link 6, which improves the redundancy of the data transfer from the downhole data processing means 4 to the uphole data processing means 5 without again having to reverse the direction of the movement of the downhole tool string 2 to measure a volume again.

Figure 3:
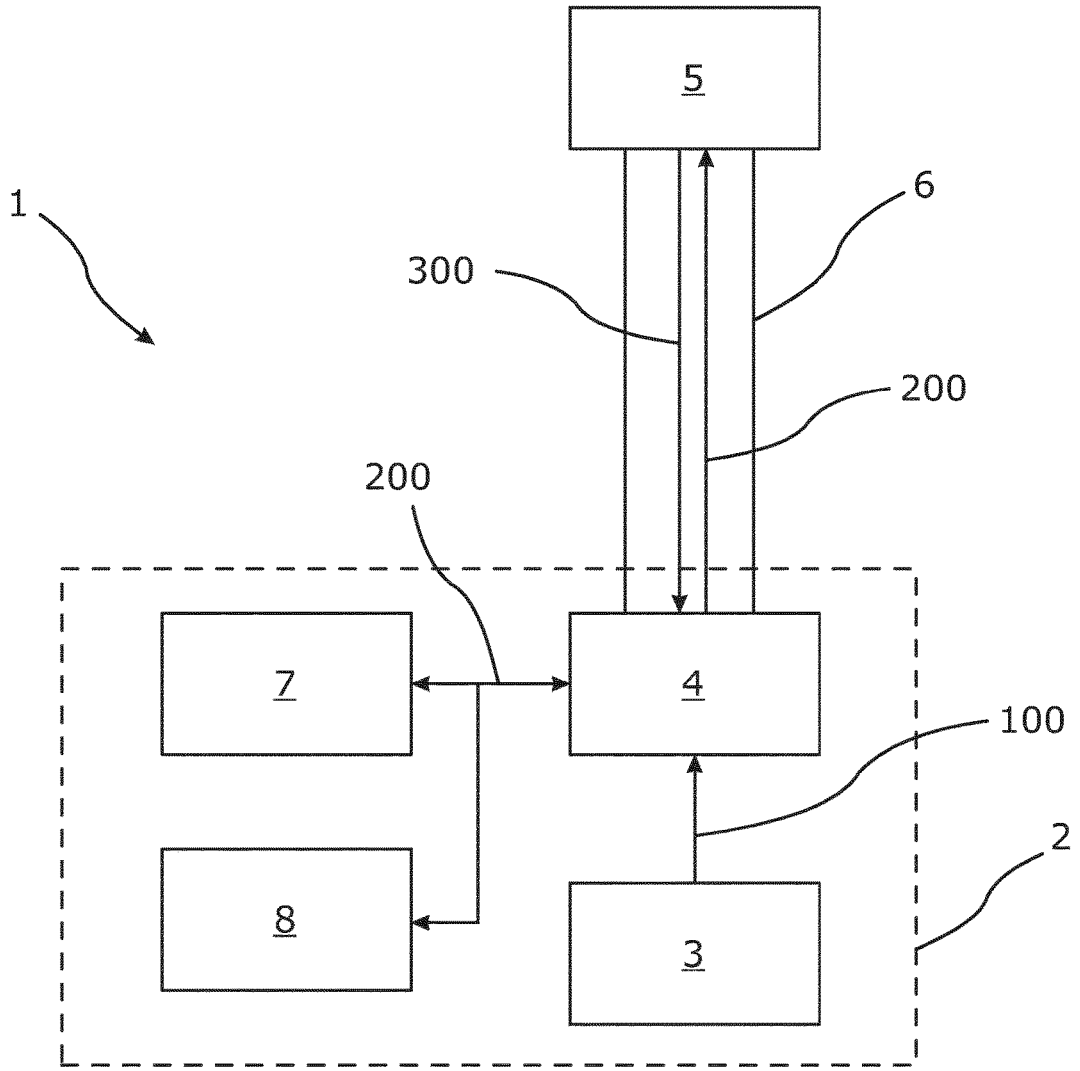
FIG. 3 shows a schematic diagram of a downhole visualisation system.

As seen in FIG. 3, the downhole visualisation system 1 may furthermore comprise a downhole data storage means 8 for storing sensor data 200 in the downhole tool string 2. Typically, the main limitation on excessive amounts of data during downhole operations is the ability to transfer data over the communication link 6 as explained above. Therefore downhole data storage means 8 may be used for storing some or all of the sensor data 200, so that a more detailed visualisation of the downhole environment may be reconstructed when the downhole tool string 2 has been retracted to the surface. The downhole data processing means 4 may in some special cases access sensor data 200 stored in the downhole storage means 8 by request from a user or the uphole data processing means 5 if the requested data is no longer accessible on the data buffering means 7.

Another type of special case may be during low data transfer periods, i.e. when low amounts of data need to be transferred over the communication link 6, e.g. during long drilling operations when required data transfer to and from the downhole tool string 2 may be at a minimum, e.g. since no control data may be required to control tools in the tool string during the drilling operation. During such low data transfer periods, the uphole data processing means 5 may unload stored sensor data 200 from the downhole data storage means 8, making more space available on the downhole data storage means 8 for a subsequent high data transfer period, e.g. when the drilling operation has been completed and new control data has to be transmitted to the tool string.

Figure 4A:
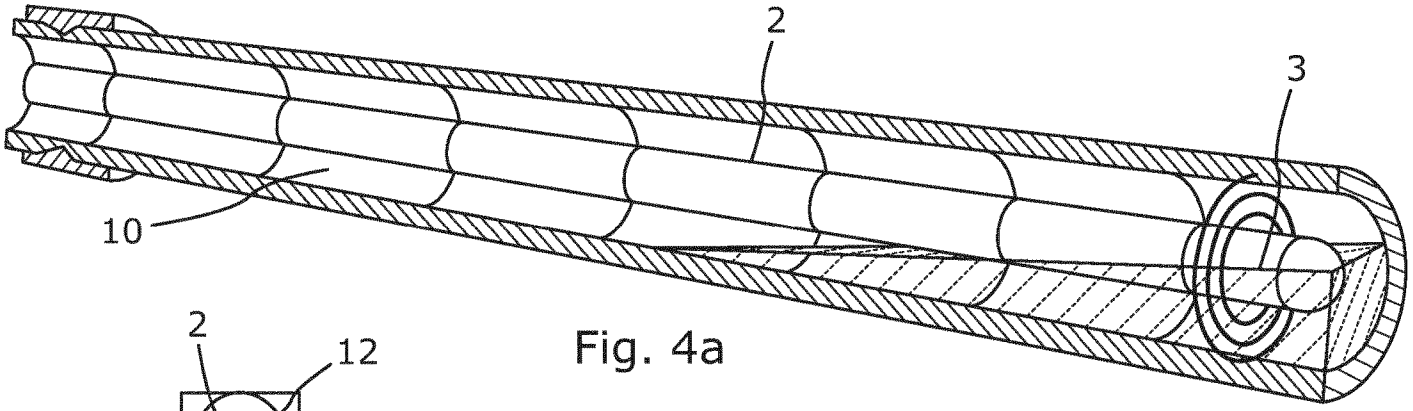
FIG. 4*a* shows a cross-sectional view of a downhole environment comprising a downhole tool string, FIGS. 4*ba*-4*bb* show a representation of sensor data of a downhole environment.
Figure 4B:
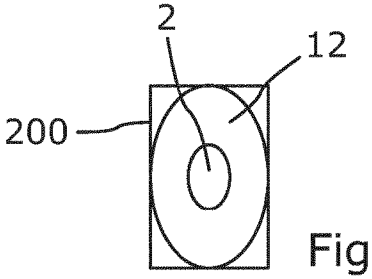
FIG. 4*c* shows a visualisation of a downhole environment.
Figure 4B:
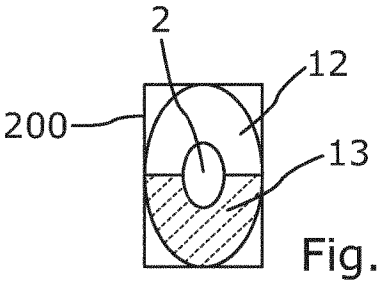
Figure 4C:
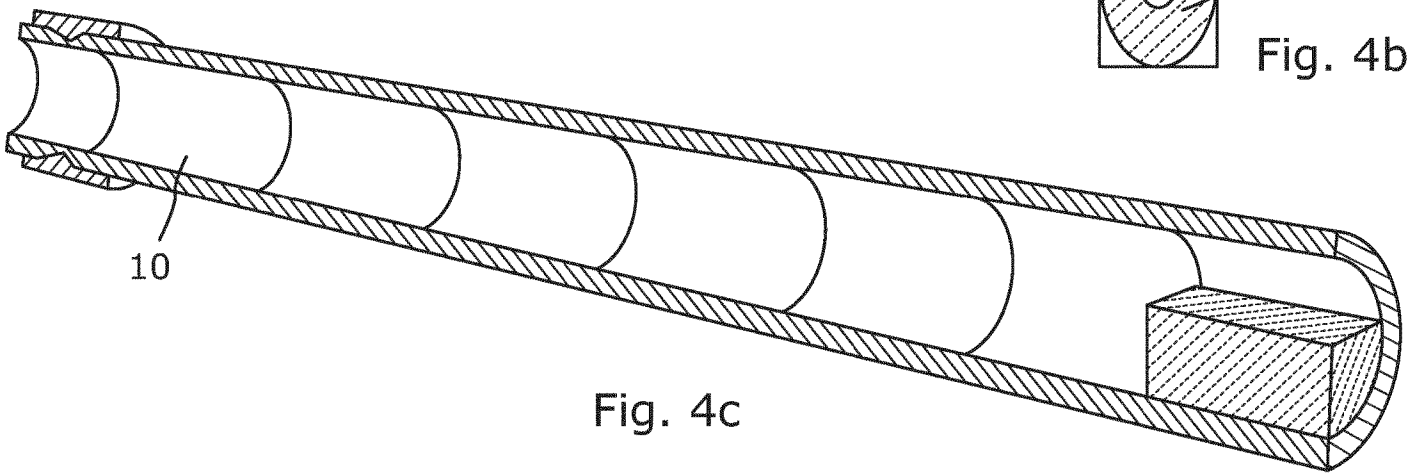

FIG. 4*a* shows a cross-sectional view of a downhole environment 10 comprising a downhole tool string 2 for measuring the physical properties of a fluid within a borehole casing, e.g. by measuring the capacitance of the surrounding fluid using a capacitance sensor 3. FIGS. 4*ba* and 4*bb* show a representation of sensor data 200 transmitted to the uphole data processing means for visualisation of the downhole environment at a low rate of data transfer, in this case represented by only two members of the sampled sensor data 200. As seen in FIG. 4*ba*, the first representation of data only indicates that the casing is filled with a first fluid 12, whereas the next representation seen in FIG. 4*bb* indicates that close to half of the casing is now filled with a second fluid 13. FIG. 4*c* is the visualisation based on only the two representations of transmitted sensor data 200 shown in FIGS. 4*ba* and 4*bb*.

Figures 5A, 5B, 5C:
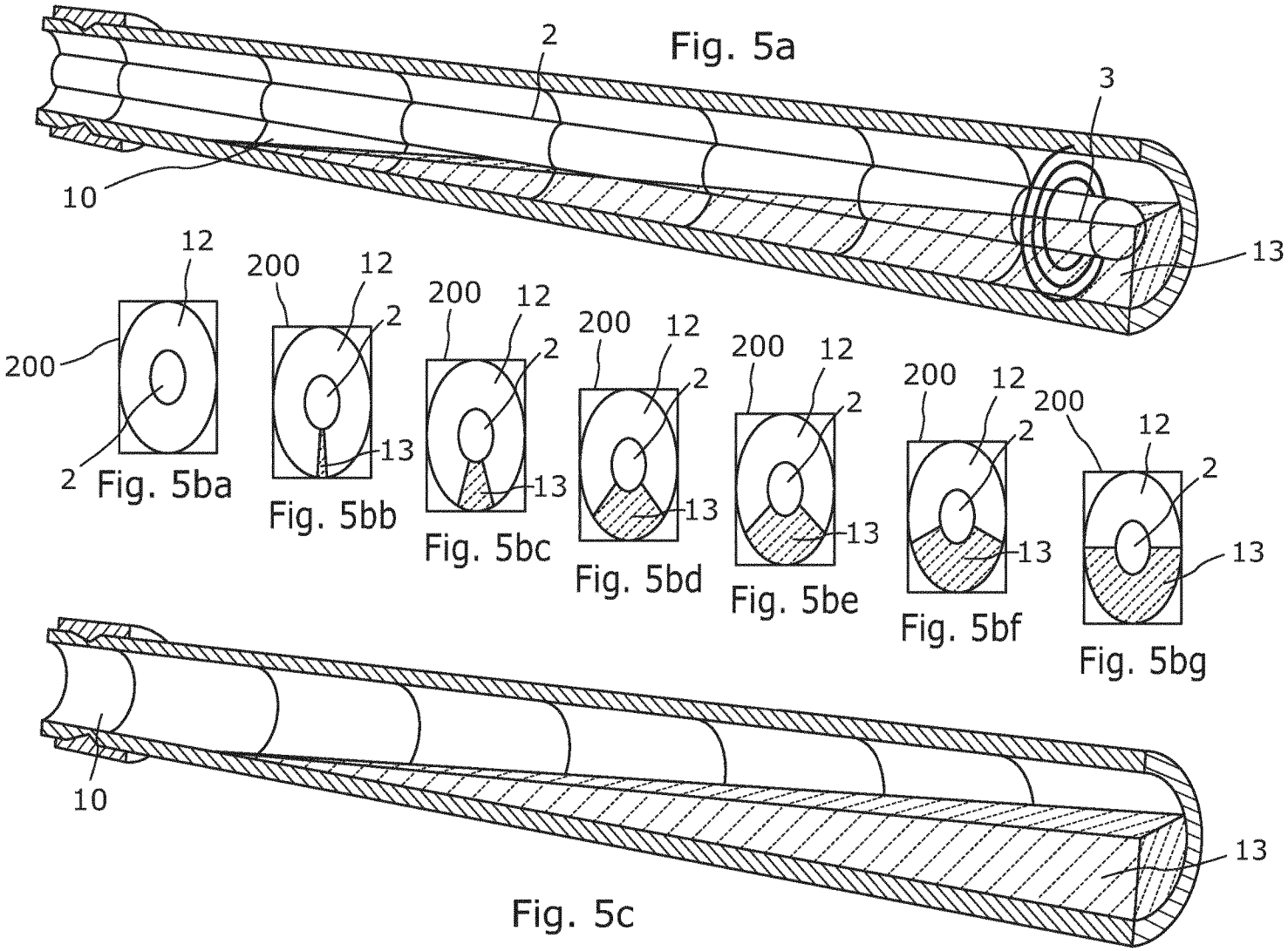
FIG. 5*a* shows a cross-sectional view of a downhole environment comprising a downhole tool string, FIGS. 5*ba*-5*bg* show a representation of sensor data of a downhole environment.
FIG. 5*c* shows a visualisation of a downhole environment.

FIGS. 5*a-c* show the measurements done in the same downhole environment 10 as described in FIGS. 4*a-c*, the only difference being that now the downhole visualisation system shown in FIG. 5*a* comprises a data buffering means. When the user or uphole data processing means recognises the feature, in this case the casing half-filled with a second fluid 13 as shown in FIG. 4*bb* and FIG. 5*bg*, additional sensor data 200 from the data buffering means as shown in FIGS. 5*bb*-5*bf* may be retracted and transmitted to the uphole data processing means so that the visualisation of the downhole environment around this recognised feature may be improved without measuring this part of the borehole casing once more.

FIG. 5*c* shows the improved visualisation of the downhole environment 10 after transmission of additional sensor data 200, i.e. the sensor data shown in FIGS. 5*bb-bf*, from the data buffering means, which now enables the user to resolve the position in which the second fluid 13 begins to be present in the downhole environment 10 in the interval between the representation shown in FIGS. 4*ba* and 5*ba*, indicating no presence of the second fluid 13, and the representation shown in FIGS. 4*bb* and 5*bg*, indicating that the casing is half-filled with the second fluid 13. Due to the additional sensor data 200 being temporarily stored in the downhole data buffering means, the improved visualisation resolving precisely the presence of the second fluid 13 may be carried out without reversing the movement of the downhole tool string 2.

The invention furthermore relates to a method of visualising a downhole environment using a downhole visualisation. The method comprises the steps of moving the downhole tool string 2 within a downhole environment 10 while sensing one or more physical parameters using the one or more sensors 3, as shown in FIG. 1. The sensor signals 100 as shown in FIG. 2 generated by the one or more sensors 3 are processed by the downhole data processing means 4 to provide sensor data 200 which is then temporarily stored as buffered sensor data 200 in the downhole data buffering means 7. The buffered sensor data 200 contains information on physical parameters obtained at a pre-set sample rate and represents all sensor data 200 obtained from the sensors. Subsequently, a first part of the sensor data 200 is transmitted to the uphole data processing means 5 at a first transmission rate equal to or lower than the sample rate. Uphole the first part of the sensor data 200 is processed using the uphole data processing means 5 and used for visualising the downhole environment 10 based on the first part of the sensor data 200. When a user or the uphole data processing means 5 recognises an event or feature such as a sudden change in one or more of the physical parameters during the visualisation of the downhole environment 10, such as explained above in relation to FIGS. 5*a-c*, wherein the capacitance sensor 3 suddenly provides sensor data 200 indicative of half of the casing being filled with a second fluid, the user or the uphole data processing means 5 sends a control signal 300 from the uphole data processing means 5 to the downhole data processing means 4, thereby changing the transmission rate from the first transmission rate to a second transmission rate.

Furthermore, a second part of the sensor data 200 stored in the downhole data buffering means 7 is transmitted at least partially to the uphole data processing means 5 to provide additional sensor data 200 to improve the visualisation of the downhole environment 10 comprising the feature causing the event in the sensor data 200 indicative of the feature. The final step of the method is to visualise the downhole environment 10 based on the first part of the sensor data 200 and the second part of the sensor data 200 chronologically before and after the event without reversing the movement of the downhole tool string 2. An example of a first part of the sensor data 200 is shown in FIGS. 4*ba* and 4*bb*, the first part of the sensor data 200 and the second part of the sensor data 200 are shown in FIGS. 5*ba*-5*bg*, and the visualisation of these data is shown in FIG. 5*c*.

The event triggering a change from a first to a second transmission rate may be e.g. a change in a casing structure, a formation structure or properties of fluids present in the downhole environment.

The method may be improved by tailoring the transmission rate to achieve the most optimal transmission rate. The sampling rate is the highest possible transmission rate since the sampling rate defines the available sensor data. The optimal transmission rate is, however, typically dependent of the objects in the downhole environment which need to be visualised. During fast travel of the downhole tool string through long passages of well tubular structure without interesting features, the transmission rate is preferably as low as possible in order to minimise data transfer over the data transmission channels. When interesting regions of the well are reached, or sudden changes in the visualisation are discovered, the transmission rate is preferably changed to a second transmission rate which is higher than the first transmission rate and lower than the sampling rate. The second transmission rates may be pre-set to accommodate different operating conditions, e.g. low second transmission rates during screenings of well structures, as opposed to high second transmission rates during precision operations.

In order to save space in the downhole data buffering means, the part of the buffered sensor data which has already been transmitted to the uphole data processing means may advantageously be deleted in the downhole data buffering means.

During extremely sensitive operations, the user may need to achieve sampling rates which are higher than the pre-set sampling rates to obtain higher resolution in the visualisation. In order to achieve this, an additional control signal may be sent to change the speed of the downhole tool string from a first to a second speed. Changing the speed to a lower speed may facilitate a second sampling rate which is higher than the pre-set sampling rate, since higher sampling rates may be achieved when the downhole tool string moves slower. After visualising the area of interest, the sampling rate may be changed to a new sampling rate by again sending an additional control signal.

When the sampling rate has changed to a lower sampling rate, the transmission rate may be higher than the sampling rate. The transmission rate is often set to the maximum possible transmission rate when the sensor of the tool string is moved past uninteresting parts in the well. And when moving past these uninteresting parts, maximum data is transmitted to surface so that space in the buffering means can be used for new acquired data. As soon as the sensor of the tool string moves into an interesting part, the sampling rate is increased again, and since not all data can be submitted to surface, part of the data is stored temporarily in the buffering means.

The method of visualising a downhole environment may comprise not only the transmission of a second part of sensor data at a second transmission rate, but also a third part of sensor data at a third transmission rate and visualising the downhole environment based on the transmitted first, second and third part of the sensor data. When the user requests a higher resolution in terms of a higher second transmission rate, the second rate may again be too small to resolve aspects of interest in the visualisation. In order to perfectly resolve the area of interest, a third part of sensor data at a third transmission rate may therefore be requested. The visualisation may subsequently be performed based on both the first second and third parts of the sensor data. The first and second parts of the sensor data have already been sent to the uphole data processing means, and therefore basing the visualisation part on all three parts may minimise the amount of data needed to be transmitted to avoid redundant data being transmitted. Fourth, fifth and even further parts of the sensor data may be transmitted at fourth, fifth or alternative transmission rates to improve resolution or minimise data transmission during specific operations.

Data buffering means 7 is to be construed as any kind of data buffer capable of storing an amount of data during a limited time interval so as to allow for the downhole data processing means 4 to perform fast operations using the data stored temporarily in the data buffering means. The data buffering means 7 may use a random access technique to read/write data faster than e.g. a sequential access technique and may therefore be used when there are high requirements to read/write speeds of the data buffering means 7. The data buffering means 7 may comprise a controller unit, the controller unit being a circuit capable of performing basic operations such as reading, writing, receiving and sending data. Having a more intelligent downhole data buffering means 7 comprising a controller unit allows the data buffering means 7 to reduce the dependency on and interaction with the downhole data processing means 4, e.g. when it is desirable to write data directly to the downhole data storage means 8.

By a random access technique is meant any technique that allows for accessing data in a random order to read/write data in order to allow for faster access to the data without the need for sorting the data, e.g. random access memory RAM.

By downhole data storage means 8 is meant any kind of data storage capable of storing data in a long-term period and in a non-volatile way so as to allow for the data to be securely stored and accessed when the downhole tool string 2 has been retracted to the surface. The storage means may use a sequential access technique to read/write data, since the read/write speed of the downhole data storage means 8 is typically less relevant since sensor data 200 stored in the downhole data storage means 8 is typically not accessed downhole. To further increase redundancy of the sensor data 200 obtained downhole, the downhole tool string 2 may comprise a plurality of data storage means 8, so that data may be distributed across the different storage means 8 in one of several ways called RAID techniques, referring to redundant array of independent disks. RAID techniques ensure redundancy of data even during breakdown of some or more disks depending on the setup, which, during downhole operations in a very harsh and violent environment, e.g. with acidic fluids and high levels of vibrations, may be advantageous, especially if the stored sensor data 200 is of great value for the operation.

By a processing means is meant any kind of processor capable of performing computations on data, sending/receiving analogue or digital data to devices connected to the processing means such as sensors 3, data buffering means 7, data storage means 8 and other processors such as the downhole and uphole data processing means 4, 5. The processing means may furthermore comprise units capable of performing specific operations such as analogue-to-digital conversion.

A data communication link 6 is to be construed as any kind of data transfer technology that is used in connection with data transfer from a downhole tool string 2, such as a wireline or an umbilical. The main purpose of the wireline is to lower downhole tool strings into boreholes and supply electrical power to the downhole tool string by using one or more conductors in the wireline. Wirelines are not optimised for data transmission, which is why limitations to data transfer via communication links 6 such as wirelines are so critical within the field of downhole operations.

Although the invention has been described in the above in connection with preferred embodiments of the invention, it will be evident for a person skilled in the art that several modifications are conceivable without departing from the invention as defined by the following claims.

The invention claimed is:

1. A method of visualising a downhole environment using a downhole visualisation system comprising a downhole tool string comprising one or more sensors, a downhole data processing means for processing the sensor signals to provide sensor data, an uphole data processing means for uphole processing and visualisation, and a data communication link operable to convey the sensor data from the downhole data processing means to the uphole data processing means, the sensors being capable of generating sensor signals indicative of one or more physical parameters in the downhole environment, the downhole visualisation system further comprising a downhole data buffering means capable of receiving the sensor data from the downhole data processing means and temporarily storing the sensor data in the downhole data buffering means, said method comprising the steps of:

moving the downhole tool string within a downhole environment, sensing, during movement, one or more physical parameters using the one or more sensors generating sensor signals indicative of one or more physical parameters in the downhole environment, processing the sensor signals to provide sensor data of a section of the downhole environment, temporarily storing the sensor data, obtained at a pre-set sample rate, in the downhole data buffering means, transmitting a first part of the stored sensor data in the downhole data buffering means to the uphole data processing means at a pre-set first transmission rate equal to or lower than the sample rate, processing the transmitted first part of the stored sensor data using the uphole data processing means and visualising the section of the downhole environment based on the transmitted first part of the stored sensor data, sending a control signal from the uphole data processing means to the downhole data processing means based on an event including a sudden change in one or more of the physical parameters during the visualisation of the downhole environment based on the transmitted first part of the stored sensor data, thereby changing the transmission rate from the first transmission rate to a second transmission rate, transmitting at least partially a second part of the stored sensor data in the downhole data buffering means to the uphole data processing means at the second transmission rate, visualising the same section of the downhole environment, based on the transmitted first part of the stored sensor data and the transmitted second part of the stored sensor data, chronologically before and after the event without reversing the movement of the downhole tool string, and generating, using the uphole data processing means and based on the transmitted first part of the sensor data stored in the data buffering means, a first visualization of the section of the downhole environment; and after transmitting the control signal and receiving the second part of the sensor data stored in the data buffering means, generating, using the uphole data processing means and based on the transmitted first part of the sensor data and the received second part of the sensor data, a second visualization of the same section of the downhole environment, wherein the generated second visualization is higher resolution than the generated first visualization of the same section of the downhole environment.

2. A method of visualising a downhole environment according to claim 1, wherein the second transmission rate is higher than the first transmission rate and lower than the sampling rate.

3. A method of visualising a downhole environment according to claim 1, further comprising a step of deleting the part of the stored sensor data in the downhole data buffering means which has been transmitted to the uphole data processing means.

4. A method of visualising a downhole environment according to claim 1, further comprising a step of sending an additional control signal to change the speed of the downhole tool string from a first to a second speed.

5. A method of visualising a downhole environment according to claim 1, further comprising a step of transmitting a third part of the stored sensor data at a third transmission rate.

6. A method of visualising a downhole environment according to claim 5, further comprising a step of visualising the downhole environment based on the transmitted first, second and third parts of the sensor data.

7. A method of visualising a downhole environment according to claim 1, wherein the event is a change in a casing structure, a formation structure or properties of fluids being present in the downhole environment.

8. A method of visualising a downhole environment according to claim 1, wherein the first transmission rate is higher than the sampling rate when the sensor of the tool string moves past uninteresting parts of the well.

9. A method of visualising a downhole environment using a downhole visualisation system comprising a downhole tool, an uphole processing system, and a communication link configured to convey data from a downhole processing system included in the downhole tool to the uphole processing system, wherein the downhole tool includes one or more sensors and a downhole data buffer, and the downhole processing system is configured to process signals from the sensor and provide sensor data, the method comprising:

moving the downhole tool within a downhole environment;

while moving the downhole tool, sensing one or more physical parameters using the one or more sensors generating sensor signals indicative of one or more physical parameters in the downhole environment;

processing, by the downhole processing system, the sensor signals to provide sensor data of a section of the downhole environment;

temporarily storing the sensor data, obtained at a pre-set sample rate, in the downhole data buffer;

transmitting a first part of the stored sensor data in the downhole data buffer to the uphole processing system at a first transmission rate equal to or lower than the pre-set sample rate;

processing, by the uphole processing system, the transmitted first part of the stored sensor data to provide a visualization of the section of the downhole environment;

when a predetermined event is detected, sending a control signal from the uphole processing system to the downhole processing system;

in response to receiving the control signal, changing the transmission rate from the first transmission rate to a second transmission rate;

transmitting at least a second part of the stored sensor data in the downhole data buffer to the uphole processing system at the second transmission rate;

providing, by the uphole processing system, a visualization of the same section of the downhole environment based on the transmitted first part of the stored sensor data and the transmitted second part of the stored sensor data, chronologically before and after the event without reversing the movement of the downhole tool string; and generating, by the uphole processing system and based on the transmitted first part of the sensor data stored in the downhole data buffer, a first visualization of the section of the downhole environment; and after transmitting the control signal and receiving the second part of the sensor data stored in the downhole data buffer, generating, by the uphole processing system and based on the transmitted first part of the sensor data and the received second part of the sensor data, a second visualization of the same section of the downhole environment, wherein the generated second visualization is higher resolution than the generated first visualization of the same section of the downhole environment.

10. The method of visualising the downhole environment according to claim 9, wherein detecting the predetermined even includes detecting, based on the transmitted first part of the stored sensor data, a sudden change in one or more physical parameters.

11. The method of visualising the downhole environment according to claim 10, wherein the visualization of the downhole environment based on the transmitted first part of the stored sensor data and the transmitted second part of the stored sensor data is provided chronologically before and after detecting the sudden change in one or more physical parameters, without reversing the movement of the downhole tool string.

12. A downhole visualization system comprising:

a downhole tool comprising one or more sensors, a buffer, and a first processing system, the first processing system being configured to at least:

while the downhole tool is moving in a section of a downhole environment, receive signals from the one or more sensors at a pre-set sample rate;

temporary store, in the buffer, sensor data corresponding to the received signals from the one or more sensors received at the pre-set sample rate;

transmit at a first transmission rate a first portion of the sensor data stored in the buffer and corresponding to the section of the downhole environment to a second processing system located outside of the downhole tool;

after transmitting the first portion of the sensor data stored in the buffer to the second processing system, receive a control signal from the second processing system; and after receiving the control signal, transmit a second portion of the sensor data stored in the buffer and corresponding to the section of the downhole environment to the second processing system at a second transmission rate that is higher than the first transmission rate; and further comprising the second processing system and the second processing system being configured to:

generate, based on the received first portion of the sensor data stored in the buffer, a first visualization of the section of the downhole environment; and after transmitting the control signal and receiving the second portion of the sensor data stored in the buffer, generate, based on the received first portion of the sensor data and the received second portion of the sensor data, a second visualization of the same section of the downhole environment, wherein the generated second visualization is higher resolution than the generated first visualization of the same section of the downhole environment.

13. The downhole visualization system of claim 12, wherein the first processing system is further configured to automatically adjust the transmission rate from the first transmission rate to the second transmission rate when it is determined that a value represented by the sensor data exceed a pre-set numerical value or a pre-set derivative value of the sensor data.

14. The downhole visualization system of claim 12, wherein the second processing system is configured to transmit the control signal to the first processing system when, based on the first part of the sensor data, a determination is made that a change in one or more physical parameters in the downhole environment exceeds a pre-set threshold.

15. The downhole visualization system of claim 12, wherein the first portion of the sensor data transmitted to the second processing system and the second portion of the sensor data transmitted to the second processing system both correspond to signals received from the one or more sensors over a same time period.

16. The downhole visualization system of claim 12, wherein the first transmission rate is lower than the sample rate of the one or more sensors, and the second transmission rate is lower than the sample rate of the one or more sensors.

17. The downhole visualization system of claim 12, wherein the first transmission rate is lower than the sample rate of the one or more sensors, and the second transmission rate is higher than the sample rate of the one or more sensors.

* * * * *